US006231314B1

(12) United States Patent
Murakami et al.

(10) Patent No.: US 6,231,314 B1
(45) Date of Patent: May 15, 2001

(54) VARIABLE DISPLACEMENT COMPRESSOR

(75) Inventors: Kazuo Murakami; Naoya Yokomachi; Takayuki Imai; Tatsuya Koide, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/362,472

(22) Filed: Jul. 28, 1999

(30) Foreign Application Priority Data

Aug. 10, 1998 (JP) ..... 10-226260

(51) Int. Cl.[7] ..... F04B 1/26
(52) U.S. Cl. ..... 417/222.1; 417/269
(58) Field of Search ..... 417/222.1, 222.2, 417/269; 62/131; 165/43

(56) References Cited

U.S. PATENT DOCUMENTS 3,738,116 * 6/1973 Gazda ..... 62/131
4,236,875 * 12/1980 Widdowson ..... 417/222.2
4,963,074 * 10/1990 Sanuki et al. ..... 417/222.1
5,362,208 * 11/1994 Inagaki et al. ..... 417/269
5,417,552 * 5/1995 Kayukawa et al. ..... 417/222.2
5,419,685 * 5/1995 Fujii et al. ..... 417/269
5,429,482 * 7/1995 Takenaka et al. ..... 417/269
5,486,098 * 1/1996 Kimura et al. ..... 417/222.2
5,529,461 * 6/1996 Kawaguchi et al. ..... 417/222.2
5,934,360 * 8/1999 Ban et al. ..... 165/43
6,012,905 * 1/2000 Takashima et al. ..... 417/222.1

FOREIGN PATENT DOCUMENTS

0945617A2 * 3/1999 (EP) .
6-129351 5/1994 (JP) .

* cited by examiner

*Primary Examiner*—Teresa Walberg
*Assistant Examiner*—Leonid Fastovsky
(74) *Attorney, Agent, or Firm*—Woodcock Washburn Kurtz Mackiewicz & Norris LLP

(57) ABSTRACT

A variable displacement compressor includes a rotary valve which can rotate synchronously with a drive shaft. The rotary valve includes a center hole with one end closed and with the other end in constant communication with a suction chamber, and a communicating hole intermittently provide a fluid communication between the center hole and a gas extracting passage extending from a crank chamber along with the rotation of the rotary valve. The amount of refrigerant gas flowing back from the crank chamber to the suction chamber through the gas extracting passage is reduced by exactly the amount of the refrigerant gas which can flow through the gas extracting passage unless it is closed by the rotary valve. Therefore, even if the sectional area of the gas extracting passage is increased to an extent of being able to prevent sludge and other foreign matter from clogging it and ensure the processing accuracy and productivity, the increase of the amount of gas fed to the crank chamber at the time of transition from a large displacement operation to a low displacement operation, and the increase in the power loss of the compressor, can be suppressed.

6 Claims, 4 Drawing Sheets

VARIABLE DISPLACEMENT COMPRESSOR

BACKGROUND OF THE INVENTION

1. Field of the Invention

The present invention relates to a variable displacement compressor suitable for use in vehicular air-conditioning system, and more particularly relates to an improvement in a variable displacement compressor of the type having a gas extracting passage providing fluid communication between a crank chamber and a suction chamber.

2. Description of the Related Art

In the related art, as a variable displacement compressor able to change its displacement, there is known one including a cylinder block provided with a plurality of bores around its center axis, a drive shaft inserted into a shaft hole of the cylinder block and supported thereby to be rotatable about its center axis, a swash plate supported by the drive shaft inside a crank chamber to be able to change an angle of inclination thereof with respect to a plane vertical to the center axis of the drive shaft, pistons coupled with the swash plate and moving reciprocally inside the bores, a housing closing off an end face of the cylinder block and having a suction chamber for a refrigerant before compression and a discharge chamber for the refrigerant after compression, a gas extracting passage providing constant fluid communication between the crank chamber and the suction chamber, a gas feed passage providing fluid communication between the crank chamber and the discharge chamber, and a displacement control valve for opening and closing the gas feed passage.

In this compressor, when the suction chamber pressure falls below a set value, the displacement control valve opens the gas feed passage in response to the pressure. When the suction chamber pressure rises above the set value, the displacement control valve closes the gas feed passage.

Therefore, when the compressor is operated at full capacity with the displacement control valve closing the gas feed passage, the refrigerant gas blowing by from the compression chambers in the bores to the crank chamber always flows through the gas extracting passage back to the suction chamber, to maintain the difference between the crank chamber pressure and the suction chamber pressure at an extremely small value and hold the swash plate at the maximum angle of inclination. When the suction chamber pressure falls below the set value in accordance with a decrease in the thermal load in the air-conditioning system, the displacement control valve is opened, to feed a high pressure refrigerant gas from the discharge chamber to the crank chamber while causing an increase in the crank chamber pressure. In other words, the difference between the crank chamber pressure and the suction chamber pressure becomes larger, and the angle of inclination of the swash plate is gradually reduced to reduce the discharge capacity of the compressor. Later, the thermal load again starts to increase due to the continuation of the low displacement operation. When the displacement control valve is closed in accordance with a rise in the suction chamber pressure above the set value, the crank chamber pressure falls because the refrigerant gas always flows passage from the crank chamber through the gas extracting passage to the suction chamber, that is, the angle of inclination of the rotating swash plate is increased. Thus, the crank chamber pressure is adjusted in accordance with the suction chamber pressure. Based on this, the angle of inclination of the swash plate is adjustably changed and the displacement of the compressor is controlled.

In the above-mentioned variable displacement compressor, while the transition from large displacement operation to low displacement operation can be achieved by positively feeding discharge refrigerant gas into the crank chamber, the refrigerant gas in the crank chamber is constantly allowed to return through the gas extracting passage to the suction chamber. Namely, a part of the refrigerant gas compressed by the compressor is used for controlling the displacement of the compressor per se. In this control system, when the sectional area of the gas extracting passage is large, the amount of the gas fed into the crank chamber at the time of transition to low displacement operation increases proportionally to the sectional area of the gas extracting passage. Thus, the amount of refrigerant gas wastefully used for transition from the large displacement operation to the low displacement operation must be increased to result in a large power loss. Therefore, in order to effectively increase the crank chamber pressure by a small amount of feed gas and to reduce the above power loss at the time of transition to the low displacement operation, the gas extracting passage needs to be formed to have a small sectional area.

If the sectional area of the gas extracting passage is made smaller, however, the sludge and other foreign matter contained in the refrigerant gas is liable to clog the gas extracting passage and results in the function as a gas extracting passage being completely lost.

Further, in the above variable displacement compressor, the gas extracting passage extending between the suction chamber and the crank chamber is normally formed to pass through the cylinder block. Further, due to the demands for reducing the weight of the compressor, aluminum alloys have recently been used as the material for cylinder blocks and pistons, but when drilling a hole of a small diameter as a gas extracting passage in a cylinder block made of an aluminum alloy, there is also a problem in that the processing accuracy and productivity are reduced due to the attachment of the chips to the drill during the drilling operation.

SUMMARY OF THE INVENTION

It is therefore an object of the present invention to provide a variable displacement compressor able to solve the problem of clogging by foreign matter and the problem of the reduction of the processing accuracy while keeping down the power loss.

According to one aspect of the present invention, there is provided a variable displacement compressor which includes a cylinder block having a center axis thereof and provided with a plurality bores around the center axis; a drive shaft inserted into a shaft hole of the cylinder block and supported by the cylinder block to be rotatable; a swash plate provided inside a crank chamber adjacent to said cylinder block and supported by the drive shaft to be able to change an angle of inclination thereof with respect to a plane vertical to the center axis of the drive shaft and to rotate together with the drive shaft; pistons coupled with the swash plate and reciprocating inside the bores; a housing closing off an end face of the cylinder block and having a suction chamber and a discharge chamber; a gas extracting passage providing fluid communication between the crank chamber and the suction chamber; a gas feed passage providing fluid communication between the crank chamber and the discharge chamber; a displacement control valve arranged on the gas feed passage and for adjustably changing the angle of inclination of the swash plate based on an adjustable change in the crank chamber pressure to thereby control a displacement of the compressor; and a valve element arranged in the gas extracting passage and operated in association with the rotation of the drive shaft so that the gas extracting passage can be opened intermittently by the valve element during the rotation of the drive shaft.

In this variable displacement compressor, since the gas extracting passage providing fluid communication between the crank chamber and the suction chamber can be intermittently opened by the valve element which is operated in association with the rotation of the drive shaft, the amount of the refrigerant gas flowing back from the crank chamber to the suction chamber through the gas extracting passage is reduced by exactly the amount of the refrigerant gas which can flow through the gas extracting passage unless it is closed by the valve element, and becomes an amount determined in response to the rotational speed of the drive shaft. Therefore, even if the sectional area of the gas extracting passage is increased to an extent of being able to prevent sludge and other foreign matter from clogging it and ensure the processing accuracy and productivity, the increase of the amount of gas fed to the crank chamber at the time of transition from a large displacement operation to a low displacement operation can be suppressed exactly by the reduced amount of the refrigerant gas flowing back to the suction chamber and therefore the increase in the power loss due to the increase in the amount of refrigerant gas wastefully used for transition to the low displacement operation can be suppressed.

In one preferred embodiment of the above-mentioned compressor, the valve element is a rotary valve to be rotatable synchronously with the drive shaft, the rotary valve comprising a center hole having one closed end and the other opened end at an end face of the rotary valve in constant communication with the suction chamber, and a communicating hole extending from the one closed end of the center hole toward the outside in a radial direction up to an outer circumferential surface of the rotary valve and intermittently permitting the gas extracting passage extending from the crank chamber to be in communication with the center hole during the rotation of the rotary valve.

In this variable displacement compressor, the communicating hole intermittently provides fluid communication between the gas extracting passage extending from the crank chamber and the center hole which is in constant communication with the suction chamber along with the rotary valve rotating synchronously with the drive shaft. Therefore, the gas extracting passage providing fluid communication between the crank chamber and the suction chamber is intermittently opened by the rotation of the rotary valve in association with the rotation of the drive shaft.

Further preferably, the cylinder block has a plurality of connecting passages for providing fluid communication between each of the bores and a valve accommodating chamber accommodating the rotary valve, and the rotary valve has a suction guide passage for permitting the center hole to be in sequential communication with the connecting passages of the plurality of bores in the suction stroke, so that the rotary valve additionally functions as a suction valve.

In this variable displacement compressor, the rotary valve for intermittently providing a fluid communication between the crank chamber and the suction chamber has an additional function as a suction valve for introducing refrigerant gas into each of the bores in the suction stroke from the suction chamber. In other words, when the rotary valve rotates synchronously with the drive shaft, the refrigerant gas in the suction chamber flows through the center hole, the suction guide passage of the rotary valve and the connecting passage of each of the bores in the suction stroke, and is sequentially sucked into each of the bores. In this way, the smooth and stable suction effect of the refrigerant gas continues in the bores and the refrigerant gas can be compressed. Therefore, the pressure loss of this compressor becomes extremely small and a sufficient volumetric efficiency can be maintained.

In another preferred embodiment of the above-mentioned compressor, the drive shaft has a center axis thereof, the end face of the drive shaft being provided with an engaging protuberance extending parallel to the center axis of the drive shaft at a position offset from the center axis thereof, and the valve element is formed as a reciprocating valve coupled with the engaging protuberance so as to be able to reciprocate in a perpendicular direction with respect to the center axis in association with the rotation of the drive shaft, the reciprocating valve element comprising an engaged portion having an elongated hole, the elongated hole extending long in a direction perpendicular to the direction of reciprocal movement of the reciprocating valve element and to a longitudinal direction of the drive shaft and engaged slidably with the engaging protuberance, and a shutter extending integrally from the engaged portion in the direction of reciprocal movement so as to close the gas extracting passage and having a through hole intermittently communicating with the gas extracting passage in response to the reciprocal movement of the reciprocating valve element.

In this variable displacement compressor, as the drive shaft rotates, the reciprocating valve element coupled with the engaging protuberance of the drive shaft reciprocates in the perpendicular direction with respect to the drive shaft. In other words, due to the rotation of the drive shaft, the engaging protuberance provided on the end face of the drive shaft at a position offset from the center axis rotates about the center axis. At this time, the engaging protuberance reciprocates in the longitudinal direction along the elongated hole of the engaged portion inside the elongated hole while rotating. Due to this, the rotational force of the engaging protuberance acts on the engaged portion as a force making the reciprocating valve element move linearly and as a result the reciprocating valve element reciprocates in the perpendicular direction perpendicular to a longitudinal axis of the drive shaft and the longitudinal direction of the elongated hole. Further, the shutter extending from the engaged portion reciprocates so as to close the gas extracting passage, and thereby the through hole provided at the shutter intermittently opens the gas extracting passage in response to the reciprocal movement of the reciprocating valve element.

Preferably, the discharge gas is discharged at a supercritical pressure of the refrigerant.

In a compressor used for a supercritical cycle cooling apparatus discharging a refrigerant gas at a supercritical pressure of the refrigerant, since the discharge pressure is high, the sectional area of the gas extracting passage needs to be smaller. Therefore, the problem of clogging by foreign matter and the problem of the reduction of the processing accuracy or others become more marked.

On this point, since it is possible in this variable displacement compressor to intermittently open the gas extracting passage by the action of the valve element, even if the compressor discharges the discharge gas at the supercritical pressure of the refrigerant, it would be possible to eliminate the problem of the clogging by foreign matter and the problem of the reduction in the processing accuracy or others while suppressing the above-mentioned power loss.

Preferably, in the above embodiment of the variable displacement compressor, the refrigerant is carbon dioxide.

BRIEF DESCRIPTION OF THE DRAWINGS

The above and other objects, features, and advantages of the present invention will be made more apparent from the following description of the preferred embodiments thereof with reference to the accompanying drawings, wherein:

FIGS. 5A to 5C are views explaining the operation of the reciprocating valve element of the compressor of the second embodiment shown in FIG. 4, wherein FIG. 5A and FIG. 5C are views illustrating the state with the gas extracting passage closed and FIG. 5B is a view illustrating the state with the gas extracting passage opened.

DESCRIPTION OF THE PREFERRED EMBODIMENTS

First Embodiment

Figure 1:
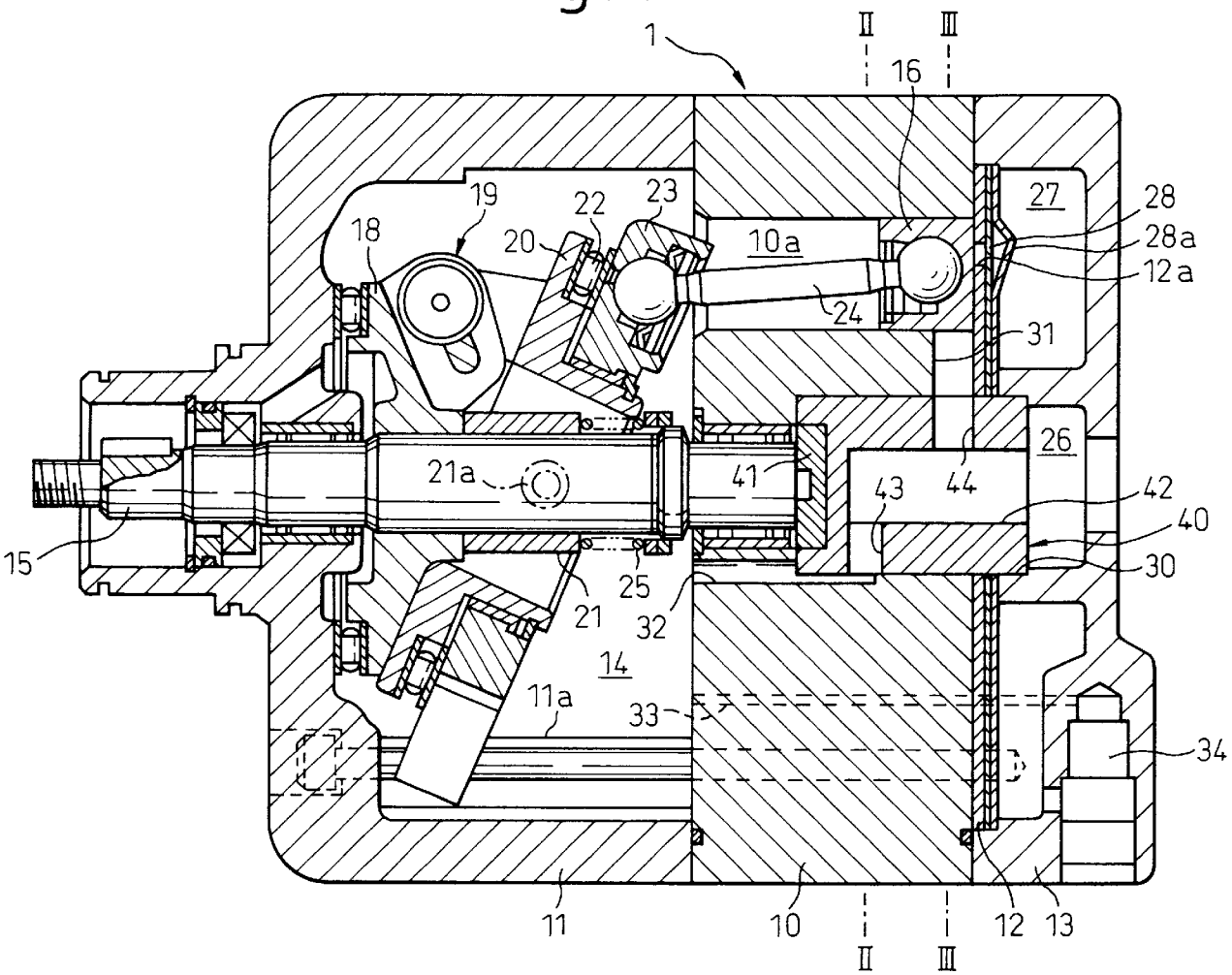
FIG. 1 is a longitudinal sectional view of a variable displacement compressor according to a first embodiment of the present invention.

The embodiment of a variable displacement compressor 1 shown in FIG. 1 is used for a supercritical cycle cooling apparatus for vehicular air-conditioning. Such cooling apparatus includes the compressor 1, a gas cooler used as a heat radiation type heat exchanger, an expansion valve used as a throttling means, an evaporator used as a heat absorption type heat exchanger, and an accumulator used as a vapor-liquid separator, which are connected in series to form a closed circuit, wherein the apparatus operates so that the discharge pressure of the compressor (the higher pressure of the closed circuit) becomes the supercritical pressure of the refrigerant circulating in the circuit. As the refrigerant, carbon dioxide ($CO_2$) is used. As the refrigerant, in addition to carbon dioxide ($CO_2$), ethylene ($C_2H_4$), diborane ($B_2H_6$), ethane ($C_2H_6$), nitrogen oxide, and the like may be used.

In the compressor 1, a front housing 11 is coupled to a front end of a cylinder block 10. A rear housing 13 is coupled via a valve plate 12 or others to a rear end of the cylinder block 10. In a crank chamber 14 defined by the front housing 11 and the cylinder block 10 is accommodated a drive shaft 15, one end of which extends from the front housing 11 and is secured to an armature of an electromagnetic clutch, not shown. The drive shaft 15 is rotatably supported by a shaft seal device and a radial bearing provided between the front housing 11 and cylinder block 10. The cylinder block 10 is formed with six bores 10*a*–10*f* at positions surrounding the drive shaft 15. Each of the bores 10*a* to 10*f* accommodates each of pistons 16.

In the crank chamber 14, a rotor 18 is fixed to the drive shaft 15 via a thrust bearing at a distance from the front housing 11 to be rotatable in synchronism with the drive shaft 15, and a rotary swash plate 20 is pivoted behind the rotor 18 via a hinge mechanism 19 to be rotatable in synchronism with rotor 18. Further, a sleeve 21 is slidingly fitted onto the circumferential surface of the drive shaft 15 in the crank chamber 14, and the rotary swash plate 20 is rockably engaged with a pivot 21*a* projecting from the sleeve 21. On the rotary swash plate 20 is held, via a thrust bearing 22 or the like, a rocking swash plate 23, to which an anti-rotation pin, not shown, slidable solely in the axial direction in an anti-rotation groove 11*a* of the front housing 11, is fixed. A connecting rod 24 is provided between the rocking swash plate 23 and the respective piston 16, so that the respective piston 16 can be reciprocated inside the bores 10*a*–10*f* in accordance with an angle of inclination of the rocking swash plate 23 with respect to a plane vertical to a center axis of the drive shaft.

A compressive spring 25 is provided between the sleeve 21 and a circlip affixed onto the drive shaft 15 on the side of the cylinder block 10. By the action of the compressive spring 25, the rotary swash plate 20 can abut the rotor 18, whereby the rocking swash plate 23 is maintained at the maximum inclination angle at the starting point. When the compressive spring 25 is compressed to the minimum extent, the rocking swash plate 23 is able to be maintained at the minimum inclination angle.

The rear housing 13 is provided with a suction chamber 26 which is open at the center on the rear side face thereof and in communicating with a later mentioned valve accommodating chamber 30 of the cylinder block 10. A discharge chamber 27 is formed in the outward region of the suction chamber 26. Compression chambers defined between the end faces of the pistons 16 and the bores 10*a*–10*f* are in communication with the discharge chamber 27 through the discharge ports 12*a* formed in the valve plate 12. The discharge ports 12*a* can be opened and closed by the discharge valve 28, an opening degree of which is restricted by a retainer 28*a* on the side of the discharge chamber 27.

Figure 3:
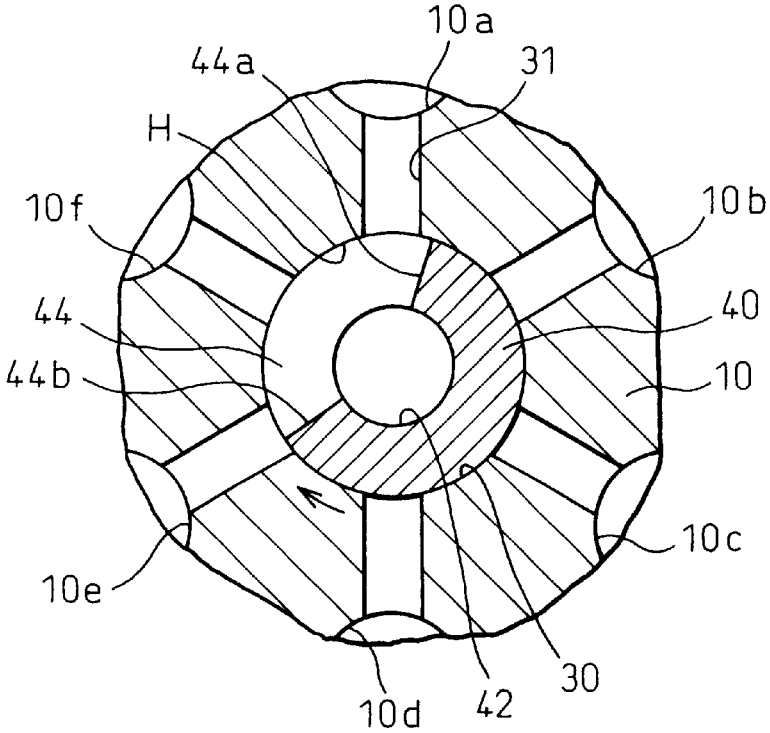
FIG. 3 is a sectional view along the line III—III of FIG. 1 of the compressor according to the first embodiment show in FIG. 1.

In the rear portion of the cylinder block 10 and the front portion of the rear housing 12 is formed a cylindrical-shaped valve accommodating chamber 30 which extends coaxially with the shaft hole of the cylinder block 10 and from the rear portion of the cylinder block 10 to the front portion of the rear housing 12 through the valve plate 12, the discharge valve 28, and the retainer 28*a*. On the rear end face of the cylinder block 10 are radially formed six connecting passages 31, each of which connects each of the tops of the bores 10*a*–10*f* with the valve accommodating chamber 30 (see FIG. 3). The front side of the valve accommodating chamber 30 is in communication with the gas extracting passage 32 which extends to the front end face of the cylinder block 10 and opens to the crank chamber 14, while the rear side of the valve accommodating chamber 30 is in communication with the suction chamber 26 of the rear housing 13. That is, the crank chamber 14 is in communication with the suction chamber 26 through the valve accommodating chamber 30 and the gas extracting passage 32. The sectional area of the gas extracting passage 32 extending between the valve accommodating chamber 30 and the crank chamber 14 is designed to prevent sludge or other foreign matter from clogging the passage and to secure the processing accuracy and productivity. Further, the sectional areas of a center hole 42 and a communicating hole 43 in a later mentioned rotary valve 40 are equal to or more than the sectional area of the gas extracting passage 32.

Figure 2:
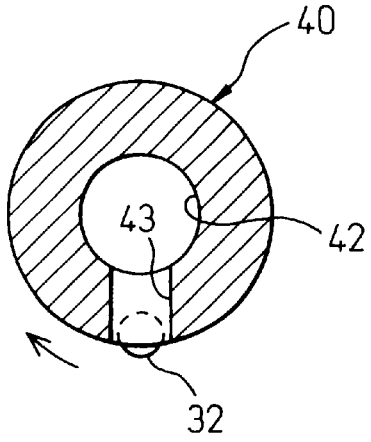
FIG. 2 is a sectional view taken along the line II—II of FIG. 1 of a rotary valve of the compressor according to the illustrated first embodiment.

The valve accommodating chamber 30 accommodates a cylindrical-shaped rotary valve 40, which is connected via a collet 41 to the rear end of the drive shaft 15 extending through the shaft hole of the cylinder block 10 to the front end of the valve accommodating chamber 30 and which is nonrotatable with respect to the drive shaft 15. The rotary valve 40 is provided with a center hole 42, at one end of which (the end to the front side of compressor 1) is closed and the other end of which (the end to rear side of compressor 1) is open to the rear end face of the rotary valve 40 and is in constant communication with the suction chamber 26, a communicating hole 43 which extends in the radial direction from the one end of the center hole 42 outward to the outer circumferential surface of the rotary valve 40 and which intermittently permits the gas extracting passage extending from the crank chamber 14 to be in communication with the center hole 42 during the rotation of the rotary valve 40, and a suction guide groove 44 which is connected to the other end of the center hole 42 and is expanded toward a limited circumferential region H aligning with the connecting passages 31 so that the suction guide groove 44 provides sequential communication between the center hole 42 and the connecting passages 31 of the bores 10*a* to 10*f* in the suction stroke (see FIG. 2 and FIG. 3). While the suction guide groove 44 faces the connecting passages 31 of the bores 10*a* to 10*f* in the suction stroke, the suction chamber 26 is in communication with the bores 10*a* to 10*f* through the center hole 42, and the rotary valve 40 functions as a suction valve.

The suction chamber 26 is connected through a pipe to the accumulator composing the refrigeration circuit of the cooling apparatus and the discharge chamber 27 is connected through a pipe to the gas cooler composing the refrigeration circuit of the cooling apparatus.

Further, through the cylinder block 10, the valve plate 12, the discharge valve 28, the retainer 28*a* and the rear housing 13 is formed a gas feed passage 33 communicating the crank chamber 14 with discharge chamber 27. In the rear housing 13 is provided a displacement control valve 34 on the middle of the gas feed passage 33. When the suction pressure falls below a preset pressure, the gas feed passage 33 is opened by means of the displacement control valve 34 and the high pressure discharge gas is fed from the discharge chamber 27 into the crank chamber 14. Therefore, by means of the displacement control valve 30, the length of the stroke of the piston 16 and the angle of inclination of the rocking swash plate 23 are adjustably changed to control a displacement of the compressor 1 in accordance with the difference between the suction chamber pressure and the crank chamber pressure which is controlled on the basis of the thermal load.

The compressor 1 of the present invention is designed as described above, and when the drive shaft 15 is rotated so that the rotational movements of the rotor 18 and the swash plate 20 are converted to backward and forward rocking movement of the rocking plate 23 into cause the plurality of different pistons 16 sequentially to reciprocate via the connecting rod 24 at different timings, the rotary valve 40 connected to the drive shaft 15 also rotates synchronously with the movement of the pistons 16. In other words, when one of pistons 16 enters the suction stroke, the wall surface 44*a* on the front side of the suction guide groove 44, with respect to the direction of rotation shown in FIG. 3, passes in a direction to open the connecting passage 31 of a bore (for example 10*b*) which had been closed up to then and as a result the refrigerant gas is sucked from the suction chamber 26 to the bore 10*b* through the center hole 42, the suction guide groove 44 of the rotary valve 40 and the connecting passage 31. When the suction stroke ends, the wall surface 44*b* on the rear side of the suction guide groove 44 passes in a direction so as to close the connecting passage 31 to stop the suction of the refrigerant to the bore 10*a*. During the discharge stroke where the piston 15 in the bore 10*b* is moving forward, the outer circumferential surface of the rotary valve 40 keeps the connecting passage 31 of the bore 10*b* in the closed state and the compressed refrigerant gas pushes to open the discharge valve 28 and is discharged via the discharge port 12*a* to the discharge chamber 27.

In this way, while the piston 16 is in the suction stroke due to the rotation of the drive shaft 15, the refrigerant gas is sucked from the suction chamber 26 to the bore through the center hole 42, the suction guide groove 44 of the rotary valve 44 and the connecting passage 31, whereby the smooth and stable suction effect of the refrigerant gas continues and the refrigerant gas can be compressed. Therefore, the pressure loss of this compressor 1 is extremely small and a sufficient volumetric efficiency can be maintained.

In a compressor 1 using carbon dioxide as a refrigerant according to the present embodiment, since the discharge pressure is high as described above, the sectional area of the gas extracting passage 32 makes it difficult to suppress the power loss caused by the feeding of discharge gas to the crank chamber 14 at the time of transition from the large displacement operation to the low displacement operation and simultaneously to eliminate the problem of the clogging by foreign matter and the problem of the reduction of the processing accuracy or others.

In this regard, in this compressor 1, the gas extracting passage 32 providing fluid communication between the crank chamber 14 and the suction chamber 26 can be opened intermittently by the rotary valve 40 operated in association with the rotation of the drive shaft. In other words, as the rotary valve 40 rotates synchronously with the drive shaft 15, the center hole 42 which is in constant communication with the suction chamber 26 is in intermittent communication with the gas extracting passage 32 extending from the crank chamber 14 via the through hole 43. In more detail, each time the drive shaft 15 turns once, the through hole 43 of the rotary valve 40 communicates once with the gas extracting passage 32. Thus, the gas extracting passage 32 is intermittently opened and refrigerant gas intermittently flows out from the crank chamber 14 to the suction chamber 26 through the gas extracting passage 32, the through hole 43, and the center hole 42. Therefore, the amount of the refrigerant gas flowing from the crank chamber 14 to the suction chamber 26 through the gas extracting passage 32 and others is reduced by exactly the amount of the refrigerant gas which can flow through the gas extracting passage 32 unless it is closed by the rotary valve 40, and becomes an amount determined in response to the rotational speed of the drive shaft 15. Therefore, even if the sectional area of the gas extracting passage 32 is increased to an extent of being able to prevent sludge and other foreign matter from clogging it and to ensure the processing accuracy and productivity in regard to the gas extracting passage, the increase of the amount of gas fed to the crank chamber 14 at the time of transition to a low displacement operation can be suppressed by exactly the amount of the reduction of the amount of the refrigerant gas flowing back to the suction chamber and therefore the increase in the power loss due to the increase in the amount of refrigerant gas wastefully used for transition to the low displacement operation can be suppressed. Therefore, even when the compressor 1 is discharging the refrigerant gas at a supercritical pressure, it is possible to solve the problem of the clogging by foreign matter and the problem associated with the processing accuracy of the gas extracting passage or others while suppressing the power loss.

Second Embodiment

Figure 4:
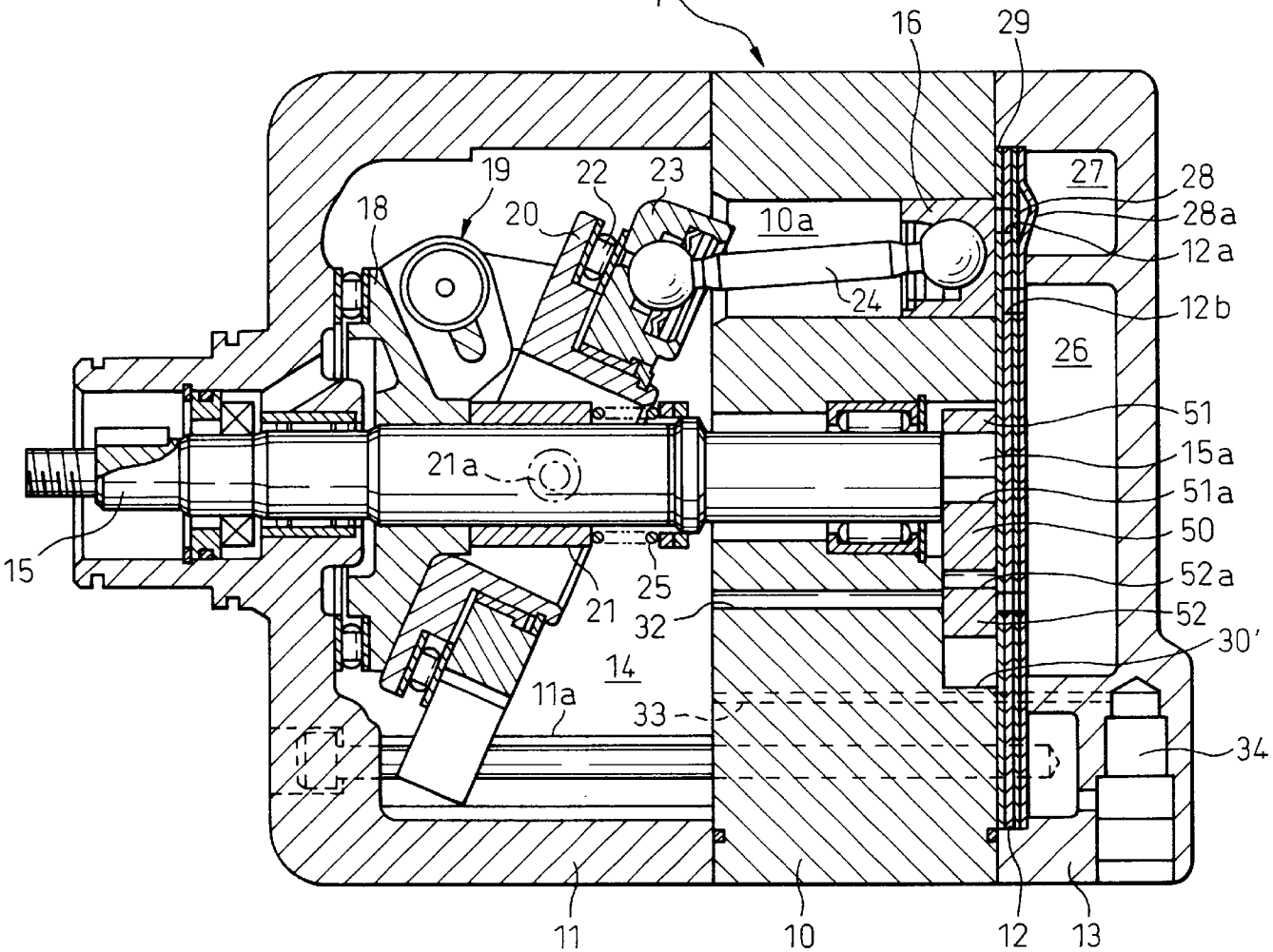
FIG. 4 is a longitudinal sectional view of a variable displacement compressor according to a second embodiment of the present invention.

A variable displacement compressor 1' according to another embodiment shown in FIG. 4 uses a reciprocating valve element 50 instead of the rotary valve 40 as the valve element which is operated in association with the rotation of the drive shaft 15.

In the compressor 1', the compression chambers defined by the end faces of the pistons 16 with the bores 10*a* to 10*f* are in communicated with the suction chamber 26 through suction ports 12*b* formed in the valve plate 12. The suction ports 12*b* are designed to be able to be opened and closed by a reed valve type suction valve 29 interposed between the valve plate 12 and the cylinder block 10. On the rear end of the cylinder block 10, a valve accommodating chamber 30' is formed so that it is connected with the shaft hole of the cylinder block 10. The valve accommodating chamber 30' includes a circular chamber 30*a* formed coaxially with the drive shaft 15 and a rectangular chamber 30*b* extending continuously downward from the circular chamber 30*a*. At the rectangular chamber 30*b* is opened a gas extracting passage 32 providing fluid communication between the crank chamber 14 and the suction chamber 26 (see FIGS. 5A–5C).

The valve accommodating chamber 30' accommodates the reciprocating valve element 50 coupled with the drive shaft 15 so as to be able to reciprocate in a perpendicular direction with respect to the drive shaft 15 (vertical direction in FIG. 4 and FIGS. 5A–5C). Specifically, the rear end face of the drive shaft 15 extending through the shaft hole of the cylinder block 10 to the front end of the valve accommodating chamber 30' is provided with an engaging protuberance 15*a* extending parallel to the center axis of the drive shaft 15 at a position most offset from the center axis (within a range where the engaging protuberance 15*a* does not project outward in the radial direction from the circumferential surface of the drive shaft 15). The rear end of the protuberance 15*a* extends to the rear end of the valve accommodating chamber 30'. On the other hand, the reciprocating valve element 50 includes an elliptically shaped engaged portion 51 having an elongated hole 51*a* which extends in a direction perpendicular to the direction of reciprocal movement (vertical direction in FIG. 4 and FIGS. 5A–5C) and to the longitudinal direction of the drive shaft 15 and is engaged slidably with the engaging protuberance 15*a*, and a rectangular shutter 52 which extends integrally from the engaged portion 51 in the direction of the reciprocal movement so as to shut the gas extracting passage 32 and which has a through hole 52*a* intermittently communicating with the gas extracting passage 32 along with the above reciprocal movement.

The length of the long axis of the engaged portion 51 of the reciprocating valve member 50 is somewhat smaller than the diameter of the circular chamber 30*a* of the valve accommodating chamber 30' so that the reciprocating valve member 50 can reciprocate in the above-mentioned direction of reciprocal movement in the valve accommodating chamber 30'. The shutter 52 of the reciprocating valve element 50 can slide in the rectangular chamber 30*b* of the valve accommodating chamber 30'. Also, the longitudinal length of the elongated hole 51*a* of the reciprocating valve member 50 is substantially equal to the outer diameter of the drive shaft 15, and the width of the elongated hole 51*a* is designed so that the engaging protuberance 15*a* can slide in the elongated hole 51*a*. Further, the diameter of the through hole 52*a* of the reciprocating valve element 50 is substantially equal to that of the gas extracting passage 32. The gas extracting passage 32 opens at a position where it is shut by the shutter 52 of the reciprocating valve element 50 other than while communicating with the through hole 52*a* of the reciprocating valve element 52.

The rest of the configuration is similar to that of the first embodiment.

In the variable displacement compressor 1', when the drive shaft 15 rotates, the reciprocating rotary valve 50 coupled with the engaging protuberance 15*a* of the drive shaft 15 reciprocates in the perpendicular direction with respect to the drive shaft 15. In other words, due to the rotation of the drive shaft 15, the engaging protuberance 15*a* located on the rear end face of the drive shaft 15 at a position offset from its center axis rotates about the center axis. At this time, the engaging protuberance 15*a* reciprocates in the longitudinal direction in the elongated hole 51*a* of the engaged portion 51 of the reciprocating valve element 50 while rotating. Due to this, the rotational force of the engaging protuberance 15*a* acts on the engaged portion 51 as a force making the reciprocating valve element 50 move linearly, and as a result, the reciprocating valve element 50 reciprocates in a direction perpendicular to the longitudinal direction of the elongated hole 51*a* and to the axial direction of the drive shaft 15. By the reciprocal movement of the shutter 52 extending from the engaged portion 51 so as to shut the gas extracting passage 32, the through hole 52*a* located at the shutter 52 intermittently opens the gas extracting passage 32 along with the reciprocal movement of the shutter 52.

Figure 5A:
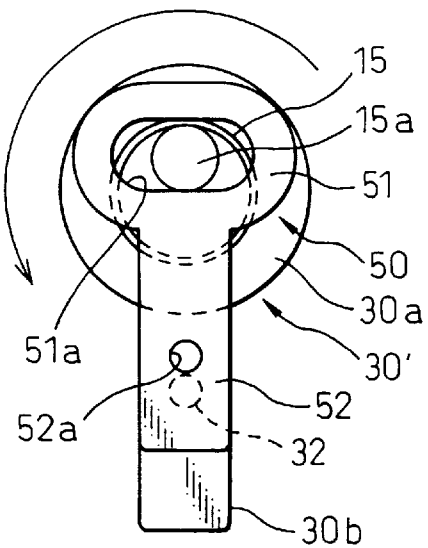
Figure 5B:
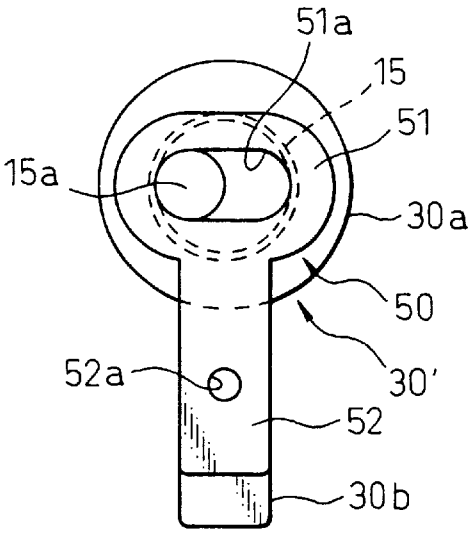
Figure 5C:
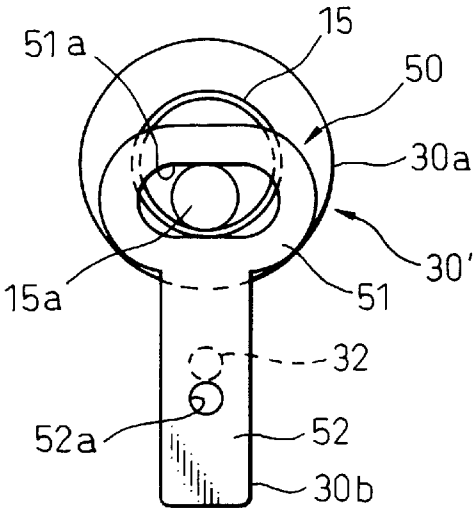

In more detail, in the state of FIG. 5A, the engaging protuberance 15*a* and the reciprocating valve element 50 are at the highest position. At this time, the engaging protuberance 15*a* is positioned at the center of the elongated hole 51*a*, and the through hole 52*b* is positioned above the gas extracting passage 32, which is shut by the shutter 52. Then, when the drive shaft 15 rotates by a ¼ turn and reaches the state of FIG. 5B, the engaging protuberance 15*a* also synchronously rotates by a ¼ turn while sliding in the elongated hole 51*a* and moves to one end of the elongated hole 51*a*. Thus, the reciprocating valve element 50 moves downward in FIG. 5A and the through hole 52*a* of the shutter 52 communicates with the gas extracting passage 32. Then, if the drive shaft 15 rotates by a ¼ turn and reaches the state of FIG. 5C, the engaging protuberance 15*a* also synchronously rotates by a ¼ turn while sliding in the elongated hole 51*a* and returns to the center of the elongated hole 51*a*. Thus, as the reciprocating valve element 50 moves further downward in FIG. 5B, the through hole 52*a* of the shutter 52 shifts downward from the gas extracting passage 32, and the gas extracting passage 32 is shut by the shutter 52. Then, when the drive shaft 15 makes a half turn from the state of FIG. 5C, the through hole 52*a* passes through the state in communication with the gas extracting passage 32 and returns once again to the state of FIG. 5A. In this way, the gas extracting passage 32 communicates with the through hole 52*a* two times each time the drive shaft 15 rotates one turn. Thus, the gas extracting passage 32 is intermittently opened and the refrigerant gas intermittently flows out through the gas extracting passage 32 and through hole 52*a* from the crank chamber 14 to the suction chamber 26.

Therefore, the compressor 1' according to the present embodiment also exhibits similar actions and effects as the first embodiment.

In the above embodiments, the explanation has been made with reference to an example of application to a supercritical cycle cooling apparatus using carbon dioxide as a refrigerant, but it is to be understood that the compressor of the present invention can also be applied to a subcritical cycle cooling apparatus using a CFC type refrigerant or an other as a refrigerant.

Further, while the present invention relates to a variable displacement compressor, there is nothing stopping application of the valve element of the present invention to a gas extracting passage of a fixed displacement compressor.

While the invention has been described with reference to specific embodiments chosen for purposes of illustration, it should be apparent that numerous modifications could be made thereto by those skilled in the art without departing from the basic concept and scope of the invention.

What is claimed is:

1. A variable displacement compressor comprising:

a cylinder block having a center axis thereof and provided with a plurality bores around the center axis;

a drive shaft inserted into a shaft hole of said cylinder block and supported by said cylinder block to be rotatable;

a swash plate provided inside a crank chamber adjacent to said cylinder block and supported by said drive shaft to be able to change an angle of inclination thereof with respect to a plane vertical to the center axis of said drive shaft and to rotate together with said drive shaft;

pistons coupled with said swash plate and reciprocating inside said bores;

a housing closing off an end face of the cylinder block and having a suction chamber and a discharge chamber;

a gas extracting passage providing fluid communication between said crank chamber and said suction chamber;

a gas feed passage providing fluid communication between said crank chamber and said discharge chamber;

a displacement control valve arranged on said gas feed passage and for adjustably changing the angle of inclination of said swash plate based on an adjustable change in the crank chamber pressure to thereby control a displacement of said compressor; and a valve element arranged in said gas extracting passage and operated in association with the rotation of said drive shaft so that said gas extracting passage can be opened intermittently by said valve element during the rotation of said drive shaft.

2. A variable discharge compressor according to claim 1, wherein: said valve element is a rotary valve to be rotatable synchronously with said drive shaft, said rotary valve comprising a center hole having one closed end and the other opened end at an end face of said rotary valve in constant communication with said suction chamber, and a communicating hole extending from said one closed end of said center hole toward the outside in a radial direction up to an outer circumferential surface of said rotary valve and intermittently permitting said extracting passage extending from said crank chamber to be in communication with said center hole during the rotation of said rotary valve.

3. A variable displacement compressor according to claim 2, wherein:

said cylinder block has a plurality of connecting passages for providing fluid communication between each of the bores and a valve accommodating chamber accommodating said rotary valve, and said rotary valve has a suction guide passage for permitting said center hole to be in sequential communication with said connecting passages of said plurality of bores in the suction stroke, so that said rotary valve additionally functions as a suction valve.

4. A variable displacement compressor according to claim 1, wherein:

said drive shaft has a center axis thereof, the end face of said drive shaft being provided with an engaging protuberance extending parallel to the center axis of said drive shaft at a position offset from the center axis thereof, and said valve element is formed as a reciprocating valve coupled with the engaging protuberance so as to be able to reciprocate in a perpendicular direction with respect to the center axis in association with the rotation of said drive shaft, said reciprocating valve element comprising an engaged portion having an elongated hole, the elongated hole extending long in a direction perpendicular to the direction of reciprocal movement of said reciprocating valve element and to a longitudinal direction of said drive shaft and engaged slidably with said engaging protuberance, and a shutter extending integrally from said engaged portion in the direction of reciprocal movement so as to close said gas extracting passage and having a through hole intermittently communicating with said gas extracting passage in response to the reciprocal movement of said reciprocating valve element.

5. A variable displacement compressor according to claim 1, wherein the discharge gas is discharged at a supercritical pressure of the refrigerant.

6. A variable displacement compressor according to claim 5, wherein the refrigerant is carbon dioxide.

* * * * *